United States Patent [19]

Komatsu et al.

[11] 4,343,221

[45] Aug. 10, 1982

[54] ACOUSTIC SOUND GENERATING DEVICE

[75] Inventors: Fumito Komatsu, Shiojiri; Makoto Orii, Nagano, both of Japan

[73] Assignee: Kabushiki Kaisha Sankyo Seki Seisakusho, Nagano, Japan

[21] Appl. No.: 149,593

[22] Filed: May 13, 1980

[30] Foreign Application Priority Data

May 24, 1979 [JP] Japan ..... 54-69894[U]

[51] Int. Cl.[3] ..... G10D 13/08

[52] U.S. Cl. ..... 84/404; 84/408

[58] Field of Search ..... 84/1.15, 94–95, 84/102, 258, 363, 364, 402–405, 408–410

[56] References Cited

U.S. PATENT DOCUMENTS

| | | | |
|---|---|---|---|
| 471,183 | 3/1892 | Miller | 84/408 |
| 2,620,702 | 12/1952 | West et al. | 84/363 |
| 2,785,595 | 3/1957 | Smith | 84/402 |
| 3,106,860 | 10/1963 | Pihl | 84/402 |
| 4,184,406 | 1/1980 | Panevska | 84/408 |

*Primary Examiner*—Lawrence R. Franklin

*Attorney, Agent, or Firm*—Sughrue, Mion, Zinn, Macpeak and Seas

[57] ABSTRACT

An acoustic sound generating device comprises a base frame, at least one vibrating rod member composed of a base end portion secured to said base frame, an intermediate portion having a small diameter and a free end portion to be picked, and a pawl segment having at least one associated picking projection for picking the free end. The pawl segment is operatively movable with the free end picked to thereby produce acoustic sounds.

14 Claims, 6 Drawing Figures

ACOUSTIC SOUND GENERATING DEVICE

BACKGROUND OF THE INVENTION

The present invention relates to an acoustic sound generating device in which at least one vibrating member mounted on a substrate or base frame is picked by pawls to thereby generate acoustic sounds.

There has been heretofore provided a so-called music box as a sound generating device in which the vibrating members are picked by the pawls. However, since the vibrating member of the music box consists of a comb-shaped vibrating plate on one side thereof with a plurality of vibrating strip members, in order to manufacture such a vibrating plate it must pass through machining processes such as a press-punching process, a grooving process, a barrel process, a combing process, a tuning process and the like, which is very intricate and also time-consuming disadvantageously.

SUMMARY OF THE INVENTION

In order to eliminate the above noted defects, an object of the present invention is to provide a novel sound generating device which is simple in construction and may be miniaturized in size, the device being manufactured with ease.

This, as well as the other objects, is achieved by the acoustic sound generating device according to the present invention wherein an end base portion of each vibrating rod is fixed to the substance or frame, a member to be picked is provided at the other free end thereof, a small diameter portion is formed midway of the vibrating rod, and a pawl member to pick said member to be picked is rotatably or reciprocatingly supported at a position to confront said member to be picked.

DESCRIPTION OF THE PREFERRED EMBODIMENTS

The present invention will now be described with reference to the accompanying drawings. A basic frame or substance 1 is angled in the form of an L letter to have an upright portion 1*a* with a pair of support holes 1*b* and 1*c* into which a pair of vibrating rods 2 and 3 are fixedly inserted. On the opposite side of the frame is formed an angled section or segment 1*d*. An opposing upright portion 1*d'* and 1*d''* are diametrically provided with a pair of bearing holes 1*e* and 1*e'*. On one side of the upright portion 1*d'* is provided a stopper engaging portion 1*d''*.

Figure 1:
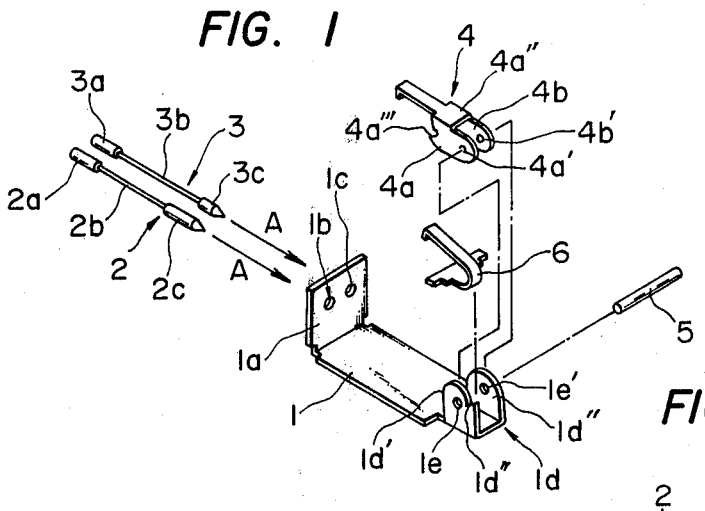
FIG. 1 is an exploded view showing an acoustic sound generating device embodying the invention.

The vibrating rods 2 and 3 include end base portions 2*a*, 3*a*, middle or intermediate portions 2*b*, 3*b* and free end portion 2*c*, 3*c* to be picked, respectively. Preferably, each portions may be manufactured by a turning lathe. The base end portions 2*a*, 3*a* have maximum diameters, the middle portions 2*b*, 3*b* have minimum diameters and the diameters of the free end portions 2*c*, 3*c* to be picked are smaller than those of the base end portions 2*a*, 3*a* and larger than those of the middle portions 2*b*, 3*b*. Accordingly, when the vibrating rods 2 and 3 are rigidly coupled to the base frame 1, the vibrating rods 2 and 3 are, as shown in FIG. 1, inserted in the arrow A directions whereby the base end portions 2*a*, 3*a* are pressingly fixed to the support holes 1*b* and 1*c*.

Tip ends of the picked portions 2*c*, 3*c* of the vibrating rods are formed in a conical shape by cutting whereby the vibrating characteristics are improved when the picked portions 2*c*, 3*c* are picked by the pawl 4. It has been found that the vibrating rods 2 and 3 are quenched or hardened after they are processed by the lathe, so that a tone or quality of a sound is further enhanced.

In a pair of opposing wall members 4*a* and 4*b* of the pawl section 4 are formed a pair of bearing holes 4*a'* and 4*b'*, and at the same time a stopper extension is formed in the wall member 4*a*. Furthermore, on the respective wall members 4*a* and 4*b* are formed respective projections 4*a'''* and 4*b''* for picking, the two projections being positioned with a displacement in phase by a predetermined angle.

The pawl section or segment 4 is rotatably mounted on the angled section 1*d* of the base frame 1 and supported around a horizontal support shaft 5 through the bearing holes 1*e*, 1*e'*, 4*a'*, 4*b'*. Between the pawl segment 4 and the base frame 1 is interposed a leaf spring member 6, and with the spring force of the member 6, the pawl segment 4 is at all times biased in a direction in which the stopper 4*a''* is engaged with the engagement portion 1*d''*. With such a structure, the original position of the pawl segment 4 is determined.

Figure 2:
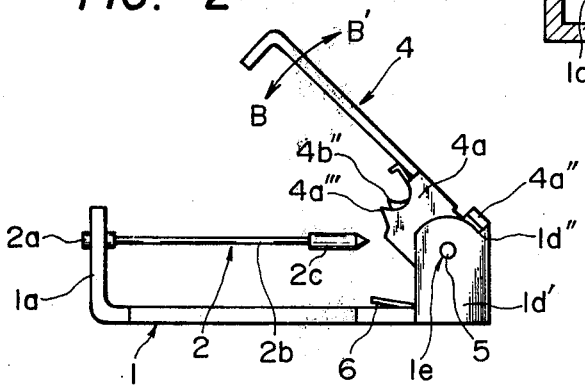
FIG. 2 is a side view showing the device shown in FIG. 1.

In operation, the pawl segment 4 is pushed down in the B direction shown in FIG. 2 to rotate, the first picking projection 4*a'''* picks the vibrating rod 2 to vibrate and then the second picking projection 4*b''* picks the rod 3. When the depression force is released, the pawl segment 4 automatically returns in the B' direction shown in FIG. 2 to the original position due to the spring force of the leaf spring member 6. At this time, the rods 3 and 2 are again picked by the picking projections 4*b''* and 4*a'''* and thereafter, the pawl member 4 restores to the original position.

Referring now to FIGS. 3 to 6, another embodiment according to the present invention will be described, in which the pawl segment 4 is not secured to the base frame 1 but fixed to a casing or enclosure 10. In this embodiment, the same reference or primed characters are used to denote the like members or parts.

Figure 4:
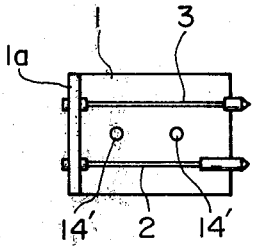
FIG. 4 is a plan view of the vibrating rods and the base frame shown in FIG. 3.
Figure 5:
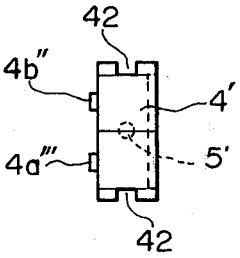
FIG. 5 is a plan view of the pawl segment shown in FIG. 3.

The above noted members are encased in the casing 10. The frame member 1 is secured to the bottom surface of the casing 10 through plural pins 14 and associated holes 14', for example, by welding. In the same manner as in the preceding embodiment, the vibrating members 2 and 3 are pressingly secured to the base frame 1 as shown in FIG. 4. A vertical extension rod 5' corresponding to the horizontal shaft 5 is formed at a suitable position of the casing 10.

Figure 3:
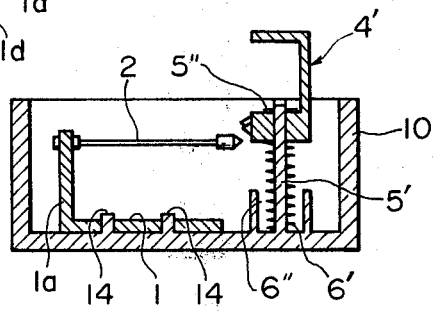
FIG. 3 is a cross-sectional view showing another embodiment according to the invention.
Figure 6:
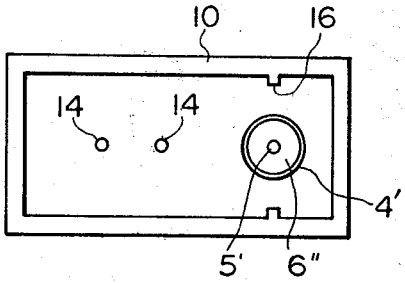
FIG. 6 is a plan view of the casing shown in FIG. 3.

A modified pawl member 4' having a pair of projections 4*a'''* and 4*b''* for picking the vibrating members 2 and 3 is slidably mounted around the extension rod 5'. The projections 4*a'''* and 4*b''* are displaced to each other in the vertical direction. Between the bottom of the casing 10 and the pawl member 4' is interposed a coil spring 6' around the extension rod 5' to thereby bias the pawl member 4′ upwardly. The spring 6′ is retained by cup means 6″ as shown in FIGS. 3 and 6. The movement of the pawl member 4′ is limited by an E-shaped ring or push nut 5″ secured to an upper portion of the extension rod 5′ and is also guided by a pair of vertical parallel guide grooves 42 formed in the side walls of the pawl member 4′, the guide grooves being slidingly engaged with a pair of projections 16 formed in inner side walls of the casing 10. With such a structure, the pawl member may be smoothly reciprocated.

The operation of the thus constructed acoustic sound generating device is obvious from that of the foregoing embodiment.

It will be understood that the number and the length of the vibrating rods are not confined to those shown in the specific embodiments and various modifications are possible within the scope of the invention.

As mentioned above, according to the present invention, since the middle portion of the vibrating rod has a minimum diameter with the middle portion being formed only by the turning lathe, the control of the length of the middle portion leads to the control over the musical or acoustic interval. As a result, the manufacturing process may be simplified and at the same time the structure also be simplified.

Also, due to the fact that the vibrating rod is made up of large, intermediate and small diameter portions, the mount in the arrow A direction is possible, and the pressing mount portion is the large diameter portion whereby the fixing is positively achieved and the vibration of the vibrating rod is achieved under the optimum condition.

Furthermore, since the round rod is used as the vibration rod, the effective contact of the pressing part to the base frame is fully carried out to thereby enhance the transmission of vibration, and the free tip end of the vibrating rod is conically cut so that after the vibrating rod is picked by the pawl section, i.e., in returning, it does not contact against the other parts.

Also, since the stopper and the spring member for biasing the stopper in one direction are used, the pawl member is at all times biased to the original position, which requires only a depression operation to achieve the two rotational or reciprocative picks.

Also, when base end portion of the large diameter portion is inserted into the hole, the portion is used as a push portion in assembly to thereby prevent it from deforming and the rotational support portion for the pawl section is formed in the base frame so that the alignment between the vibrating rod and the pawl section is easily and correctly carried out.

What is claimed is:

1. An acoustic sound generating device comprising a base frame, at least one vibrating rod member formed of a base end portion secured to said base frame, an intermediate portion having a small diameter and a free end portion to be picked, and pawl segment means, movably supported by said base member and having at least one associated picking projection, for picking said free end portion of said vibrating rod while moving along a predetermined path from a first position to a second position to thereby produce acoustic sounds and for picking said free end again while returning along said predetermined path from said second position to said first position.

2. An acoustic sound generating device as defined in claim 1, wherein said pawl segment means reciprocates in an arcuate path relative to said free end portion of said vibrating rod.

3. An acoustic sound generating device as defined in claim 1, wherein said pawl segment means is reciprocative in a vertical path relative to said free end portion of said vibrating rod.

4. An acoustic sound generating device as defined in claims 1, wherein said free end portion is formed in a conical shape.

5. An acoustic sound generating device as defined in claims 1, wherein said base end portion is pressingly secured to said base frame.

6. An acoustic sound generating device as defined in in claims 1, wherein said base end portion has a maximum diameter, said intermediate portion has a minimum diameter and said free end portion has an intermediate diameter.

7. An acoustic sound generating device as defined in claims 1, wherein said pawl segment means is pivotably supported by said base frame to allow movement of said pawl segment in an arcuate path.

8. An acoustic sound generating device as defined in claims 1, wherein said pawl segment means is slidingly reciprocatively supported by said base frame.

9. An acoustic sound generating device as defined in claims 1, further comprising a casing to which said base frame is secured, wherein said pawl segment means is supported by said casing to allow movement of said pawl segment in an arcuate path.

10. An acoustic sound generating device as defined in claims 1, further comprising a casing to which said base frame is secured, wherein said pawl segment means is slidingly reciprocatively supported by said casing.

11. An acoustic sound generating device as defined in claims 1, wherein said pawl segment means is biased in one direction.

12. An acoustic sound generating device as defined in claim 1, further including stopper means for defining said first position of said pawl segment means.

13. An acoustic sound generating device as defined in claim 1, further including a plurality of said vibrating rod members, wherein said pawl segment means has a plurality of said associated picking projections, each of said projectons being staggered with respect to adjacent projections.

14. An acoustic sound generating device comprising a base frame, at least two vibrating rod members, each vibrating rod member formed of a base end portion secured to said base frame, an intermediate portion having a small diameter and a free end portion to be picked, and a pawl segment means, movably supported by said base member and having at least two associated picking projections, one for picking each said free end portion of said vibrating rod while moving along a predetermimed path from a first position to a second position to thereby produce acoustic sounds and for picking said free end again while returning along said predetermined path from said second position to said first position; said picking projections being staggered to produce said acoustic sounds sequentially.

* * * * *